US005207046A

United States Patent [19]

Vekkeli

[11] Patent Number: 5,207,046

[45] Date of Patent: May 4, 1993

[54] WOODEN STRUCTURE, AND A ROLLER PRESS FOR PRODUCING THE STRUCTURE

[75] Inventor: Jouko Vekkeli, Heinola, Finland

[73] Assignee: Jatwood Oy, Finland

[21] Appl. No.: 640,319

[22] PCT Filed: Jul. 25, 1989

[86] PCT No.: PCT/FI89/00140

§ 371 Date: Jan. 25, 1991

§ 102(e) Date: Jan. 25, 1991

[87] PCT Pub. No.: WO90/01092

PCT Pub. Date: Feb. 8, 1990

[30] Foreign Application Priority Data

Jul. 26, 1988 [FI] Finland ..... 883517

[51] Int. Cl.[5] ..... E04C 3/30; B30B 3/00

[52] U.S. Cl. ..... 52/730.7; 100/144; 100/155 R; 52/731.3; 52/745.19

[58] Field of Search ..... 52/730, 731; 100/144, 100/155 R, 913

[56] References Cited

U.S. PATENT DOCUMENTS

| | | | |
|---|---|---|---|
| 688,603 | 12/1901 | De Walt | 52/731 |
| 792,342 | 6/1905 | Nesselroad . | |
| 1,752,103 | 3/1930 | Morrison . | |
| 3,170,201 | 2/1965 | Nofziger | 52/731 |
| 3,477,485 | 11/1969 | Talbot . | |
| 3,960,637 | 6/1976 | Ostrow | 52/730 |
| 4,712,286 | 12/1987 | Wolf | 52/731 |
| 4,715,162 | 12/1987 | Brightwell | 52/730 |
| 4,983,070 | 1/1991 | Hwang | 52/731 |
| 4,987,717 | 1/1991 | Dameron, Jr. | 52/731 |

FOREIGN PATENT DOCUMENTS

| | | | |
|---|---|---|---|
| 0086899 | 12/1982 | European Pat. Off. . | |
| 0292961 | 5/1988 | European Pat. Off. . | |
| 2145226 | 3/1973 | Fed. Rep. of Germany | 52/731 |
| 2613675 | 10/1977 | Fed. Rep. of Germany . | |
| 3048359 | 12/1980 | Fed. Rep. of Germany . | |
| 862937 | 3/1986 | Finland . | |
| 75207 | 11/1986 | Finland . | |
| 413711 | 7/1934 | United Kingdom | 52/731 |
| 2182370 | 5/1987 | United Kingdom | 52/731 |

OTHER PUBLICATIONS der Möbelau, Fritz Spannagel, Otto Maier Verlag, Ravensburgh, 1954, pp. 81–83.

*Primary Examiner*—Peter M. Cuomo
*Assistant Examiner*—Michael Milano
*Attorney, Agent, or Firm*—Andrus, Sceales, Starke & Sawall

[57] ABSTRACT

The invention relates to an elongated wooden structure and a roller press for producing the structure. The wooden structure consists of four pieces (31) joined together and extending from end to end of the structure, said pieces having uniform dimensions in both the transverse and longitudinal directions and an essentially rectangular cross section, the joint surfaces of said pieces being provided with jointing grooves (32) and corresponding tongues (33). The roller press comprises at least one four-roller unit in which the axes of rotation (5,6,7,8) of all four rollers (1,2,3,4) are located in one plane perpendicular to the longitudinal direction of the object to be pressed.

11 Claims, 3 Drawing Sheets

WOODEN STRUCTURE, AND A ROLLER PRESS FOR PRODUCING THE STRUCTURE

The present invention relates to a wooden structure and to a roller press designed for use in the production of elongated wooden structures as defined in claim 1.

BACKGROUND OF THE INVENTION

U.S. Pat. No. 4,394,409 proposes an elongated wooden structure consisting of four pieces of a sectorial cross-sectional form which, when glued together, form a tubular beam of a square cross-section.

At present, as the numbers of massive tree trunks are decreasing, saw mills are receiving increasing numbers of trunks of a small diameter, from which it is not always possible to produce sawn timber of sufficient size. In the above-mentioned U.S. Pat. No., this is achieved by sawing the wood into pieces of a triangular cross section which are then joined together to produce larger bodies. However, such a structure has the drawback that the wood has to be sawn expressly for this purpose, whereas normally the wood is sawn into pieces of a rectangular cross section.

Previously known are also different tubular structures made of boards joined using various, generally metallic holding means, e.g. nails or angle iron fasteners. However, such structures are difficult and expensive to manufacture industrially, and their strength is generally of a low order.

SUMMARY OF THE INVENTION

The object of the invention is to eliminate the drawbacks referred to and to achieve a wooden structure which can be easily assembled from essentially rectangular pieces and is well suited for industrial production. Another object of the invention is to create a roller press designed for industrial production of the wooden structure of the invention.

As for the features characteristic of the invention, reference is made to the claims.

The elongated wooden structure of the invention consists of four pieces having essentially uniform dimensions in both the transverse and longitudinal directions and an essentially rectangular cross-sectional form, which are joined together and extend from one end of the structure to the other. According to the invention, one of the broader sides of each piece is provided with jointing grooves extending from end to end of the piece, while one of the narrower sides is provided with tongues corresponding to the grooves, so that the pieces can be joined together to form a hollow tubular structure.

Said pieces are preferably fully identical in cross-sectional form, so that they can be manufactured using the same cutter construction. The resulting wooden structure is a tubular body of a square cross section.

In another embodiment of the invention, the structure is of a rectangular cross-sectional form, in which case the pieces on opposite sides are identical and the structure can be used as a beam of either flat or elevated cross section, depending on practical requirements.

The structure of the invention has many advantages over previously known wooden structures. It can be made of the lower-quality, rough-edged surface boards that are always produced in the sawing of timber, because the rough-edge sides can be hidden inside the structure if the boards are correctly planed. In this way, it is also possible to produce completely knotless wooden structures from surface boards.

The structure is easy to produce in a continuous process because, due to the strength of the structure, successive pieces can be glued together end to end using only butted joints or, if desirable, finger joints.

The structure is symmetrical and rigid. It does not bend like beams made of solid wood. Also, the structure requires less and lower-quality wood material than corresponding solid-wood timber with the same strength properties.

Further advantages over thicker timber are that the pieces will dry faster and require less drying energy, and that they can be better and more quickly impregnated, if necessary.

The wooden structure of the invention can be used e.g. in the skeletal structures of buildings, in various load-bearing structures, door frames, fence poles, table legs etc. Moreover, the cavity inside the structure can be used as a duct for the mounting of electrical and other conductors and piping.

When elongated bodies of a rectangular cross-sectional form are manufactured by joining several pieces together by pressing and glueing, problems are frequently caused by the uneven and obliquely directed pressure loads resulting from the relative positions of the pressing rollers, with the consequence that the obliquely directed forces applied to the pieces may damage the tongues and grooves or equivalent provided on the pieces. On the other hand, if the pressing rollers are exactly aligned, problems are encountered in the adjustment of the rollers, because the same press must be able to press different-sized pieces of a rectangular or square cross section.

To eliminate the problems mentioned above, the roller press designed for manufacturing wooden structures as provided by the invention comprises at least one four-roller unit for pressing an elongated body of a rectangular cross-sectional form from all four sides. In the unit, the shafts of the first and third rollers are parallelly positioned relative to each other and the rollers are on opposite sides of the body to be pressed, applying a pressure on its surfaces, and the shafts of the second and fourth rollers are parallelly positioned relative to each other, at right angles to the shafts of the first and third rollers, and the rollers are placed on opposite sides of the body to be pressed, applying a pressure on its surfaces. According to the invention, the axes of rotation of all four rollers lie in one plane perpendicular to the longitudinal direction of the body to be pressed, in such manner that the first roller is fixedly mounted with bearings on the frame of the press, the second and third rollers are arranged to be immovable relative to each other in the direction of the axis of the first roller but movable together in this same direction, while the third and fourth rollers are arranged to be immovable relative to each other in the direction of the axis of the second roller but movable together in this same direction.

Thus, the basic idea of the roller press of the invention is that while one roller is fixedly mounted the other three rollers can be moved in pairs relative to the fixed roller in such manner that the second and third rollers form a pair that moves only in the direction of the shaft of the first roller, whereas the third and fourth rollers form a pair that moves only in a direction perpendicular to the shaft of the first roller, the shafts of all four rollers being located in the same plane perpendicular to the longitudinal direction of the body to be pressed. Moreover, the rollers are placed at some distance from each other so that they can move without touching each other during adjustment of the opening size of the press.

The roller press preferably comprises several four-roller units rigidly connected to each other in such manner that the above-mentioned adjustments regarding rollers pressing against the same surface of the body take place simultaneously.

The other embodiments and features of the construction of the roller press of the invention are as stated in the claims and in the explanation of the appended drawings.

Compared to previously known presses, the roller press of the invention has the advantage that the pressure is applied to the body to be pressed in exactly one plane perpendicular to its longitudinal direction, so that the pieces to be joined are not subjected to any forces that may damage or twist their jointing parts. An additional advantage is the ease and variety of adjustments provided in spite of the rollers lay-out described above.

DESCRIPTION OF THE DRAWINGS

In the following, the invention is described by way of example without restricting it in any way, reference being made to the drawing attached, wherein.

DESCRIPTION OF THE ILLUSTRATED EMBODIMENT

Figure 1:
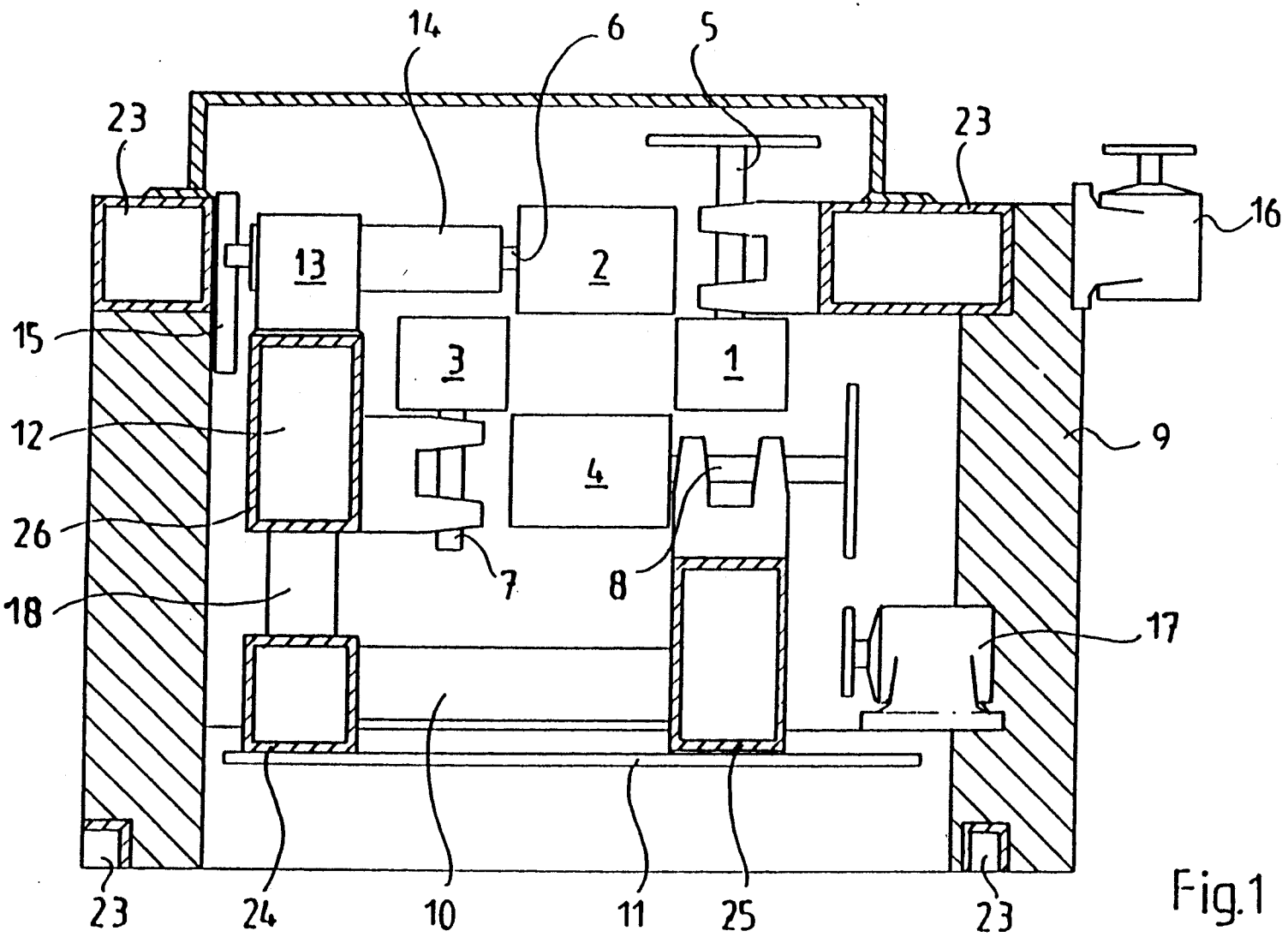
FIG. 1 presents a diagram of an embodiment of the roller press of the invention in section.

The roller press shown in FIG. 1 comprises four cylindrical rollers 1, 2, 3, 4, which are so arranged that the shafts 5 and 7 of rollers 1 and 3 are parallel to each other while the shafts 6 and 8 or rollers 2 and 4 are parallel to each other and perpendicular to shafts 5 and 7, leaving a rectangular opening in the middle of the rollers.

The shaft 5 of the first roller 1 is fixedly mounted with bearings on the press frame 9. Attached to the frame is also a power means 16 for rotating the roller 1. Thus, the roller cannot move axially relative to the frame 9, but only rotate while remaining in place. The roller press is provided with an auxiliary frame 10 which is mounted with slide rails 11 on the press frame 9 and is movable in a direction perpendicular to the longitudinal direction of the object to be pressed, i.e. in the direction of the shafts 6 and 8. The shaft 8 of the fourth roller 4 is fixedly mounted with bearings on the auxiliary frame, which is also provided with a power means 17 for rotating the roller 4.

The auxiliary frame 10 is provided with a vertical support 18 which lies parallel to shafts 5 and 7 and carries an additional frame 12 movable along the vertical support and supporting the third roller 3, which is rigidly attached to a rotatable shaft 7 mounted on the additional frame 12. At the upper end of the vertical support 18 is a sliding holder 13 which surrounds a sleeve 14 mounted on the shaft 6 of the second roller 2, parallel to shafts 6 and 8. The roller 2 is attached to shaft 6, which is rotatable inside the sleeve 14 supporting it. The shaft end pointing away from the roller 2 is guided by a guide track 15 attached to the frame 9, in such manner that the shaft 6 is allowed to slide in a direction perpendicular to itself, i.e. in the direction of shafts 5 and 7, but not in the direction of shafts 6 and 8.

Figure 2:
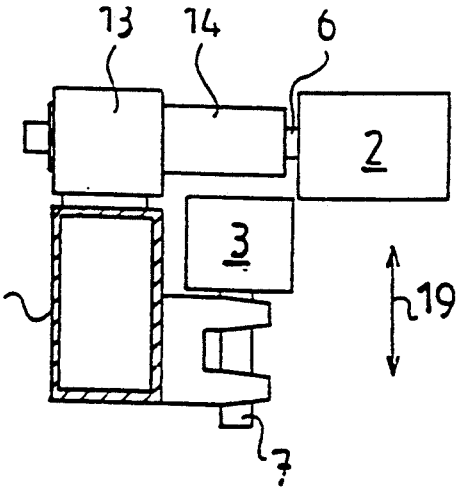
FIG. 2 presents the press components moving along with rollers 2 and 3.

With the rollers arranged and connected in this way, rollers 2 and 3 can be moved as a rigid unit, shown in FIG. 2, in the direction of shafts 5 and 7 as indicated by the arrow 19. In this case, rollers 1 and 4 remain in place and the height of the opening of the press, i.g. the distance between rollers 2 and 4, is changed while the width, i.e. the distance between rollers 1 and 3, remains unchanged.

Figure 3:
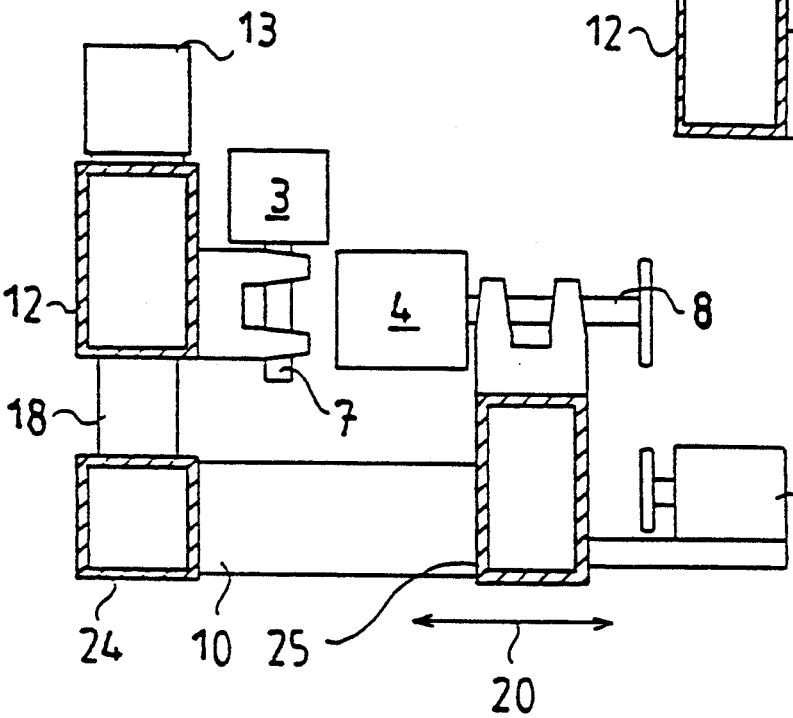
FIG. 3 presents the press components moving along with rollers 3 and 4.

FIG. 3 represents the auxiliary frame 10, the roller 4 fixedly mounted on it, and the roller 3 supported on it by means of the additional frame 12. When the the auxiliary frame 10 is moved in the direction of the arrow 20, the auxiliary frame will move along the slide tracks 11 while the sliding holder 13 slides along the sleeve 14 so that roller 2 and its shaft 6 remain in place while only rollers 3 and 4 move in the direction of shafts 6 and 8, whereby the width of the press opening, i.e. the distance between rollers 1 and 3 is changed while the height, i.e. the distance between rollers 2 and 4, remains constant.

The rollers 1, 2, 3, 4 are located at a suitable distance, e.g. a few millimeters, from each other so that they can move past each other in the above-described manner without touching each other.

Figure 4:
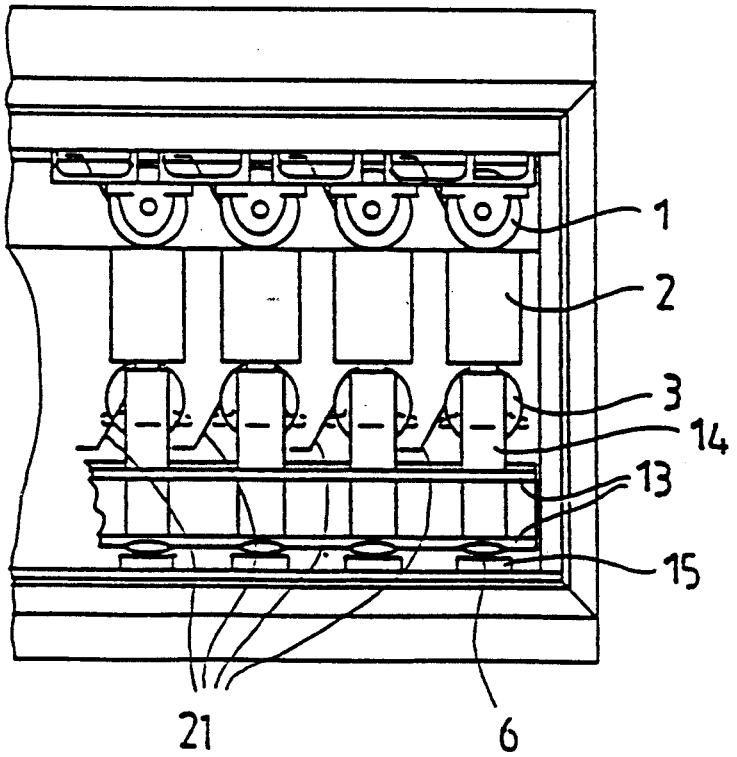
FIG. 4 presents a part of a roller press consisting of several units.

FIG. 4 shows part of an embodiment of the invention, in which the roller press consists of a number of successive four-roller pressing units forming a long pressing tunnel where the object to be produced is pressed and subjected to a suitable treatment to enable the glue in the seams to harden before the product is delivered from the press. Such treatment may consist, e.g. of suitable heating and air-blowing operations. A shown in FIG. 4, each roller in at least the foremost four-roller units is provided with a scraper 21 which shaves off any glue that may remain on the roller surface after the pressing operation, thus preventing other parts of the object surface from getting soiled.

In a roller press consisting of a number of successive four-roller units as shown in FIG. 4, the press frame 9 comprises elongated beams 23 extending from end to end of the press. Moreover, the auxiliary frame 10 also comprises two elongated beams 24 and 25 connecting the auxiliary frames 10 of adjacent four-roller units, forming a rigid assembly enabling the auxiliary frames 10 to move simultaneously relative to the frame 9. Similarly, the additional frame 12 also comprises an elongated beam 26 connecting the additional frames 12 of different units to form a rigid assembly enabling the two-roller assemblies, illustrated by FIG. 2, in successive pressing units to be moved simultaneously in the direction of the arrow 19.

Figure 5:
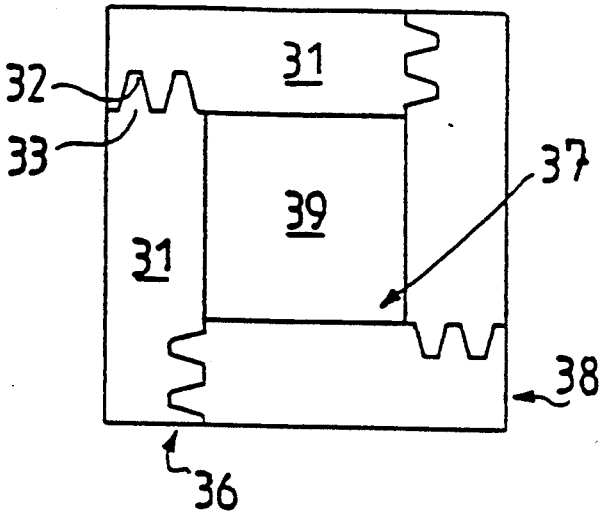
FIG. 5 shows the cross section of an embodiment of the wooden structure of the invention.

As illustrated by FIG. 5, the wooden structure of the invention consists of four elongated pieces 31 identical in cross section. Each piece is of an essentially rectangular cross-sectional form and has a width equalling about four times its thickness. One 36 of the narrower sides of each piece is provided with two tongues 33 of a shape tapering from a wider base toward a narrower tip, said tonques extending over the whole length of the piece. The broader side 37 of each piece 31 is provided with jointing grooves 32 of a shape corresponding to the tongues 33, said grooves being located near the other narrower side 38. Thus, the four pieces can be joined together longitudinally at an angle of 90° relative to each other to form a tubular structure of a square cross section. The joining is preferably effected using glue, and the parts are pressed together using the roller press of the invention. The result is a wooden structure that is lighter, stronger, rigider and straighter than a solid-wood body of corresponding external dimensions. It is to be noted that, although the embodiment described uses two tongues and two grooves for each joint, their number (one or more) can be varied depending on the need in each case.

Figure 6:
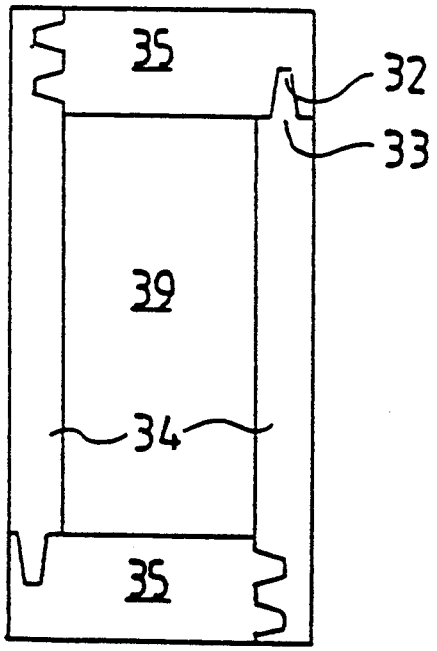
FIG. 6 shows the cross section of another embodiment of the wooden structure of the invention.

FIG. 6 shows another embodiment of the wooden structure of the invention, having a rectangular cross-sectional form. In this structure, the opposite side pieces 34 and the opposite upper and lower pieces 35, respectively, are identical. The side pieces are wide and thin while the upper and lower pieces are narrower and thicker. When the pieces are thus joined together with suitable tongues and grooves as shown in the figure, the result is an elongated beam structure which is considerably lighter than solid-wood beams of corresponding size and yet superior in strength and load-bearing capacity.

In the embodiments shown in FIGS. 5 and 6, the wooden structure has a hollow space 39 inside it, which can be used e.g. to accommodate various conductors.

The embodiments described use grooves and tongues of a cross-sectional form essentially resembling a truncated cone. However, the joints can also be implemented using other known types of round-shaped or angular finger joints, tongue-and-groove joints or equivalent.

Using the roller press of the invention, a finished wooden structure is provided by the invention can be produced by applying a pressure in a single direction perpendicular to the longitudinal direction of the structure in such manner that the joining grooves and tongues are not subjected to any oblique forces that may damage them, ensuring that the joints will be strong and the resulting wooden structure a durable and lightstructural element suited for use for various purposes.

I claim:

1. An elongated wooden structural beam, consisting of four elongated generally rectangular pieces of wood each having a pair of ends and a pair of first sides extending between said ends and a pair of opposed second sides extending between said ends, each side having a length extending between the ends of the piece and having a transverse width normal to said length, said first sides having a greater width than said second sides, the length of each side being substantially greater than the width of each side, one of said first sides of each piece being provided with a groove extending between said ends and one of said second sides of each piece being provided with a tongue extending between said ends and disposed in mating relation with a groove of an adjacent piece whereby the pieces are joined together to form a hollow tubular structure, and adhesive means disposed between the contacting surfaces of said pieces including the mating tongues and grooves to join the pieces together in the configuration of a hollow elongated beam.

2. The structure of claim 1, in which each tongue is tapered inwardly in a direction away from said second side and each groove has a configuration to compliment the tapered tongue.

3. A roller press, comprising a press frame, four rollers mounted on said frame and disposed to press an elongated body of generally rectangular cross section from all four sides of the body, each of said rollers having a shaft, a first of said rollers and a third of said rollers disposed on opposite first sides of the body and a second roller and a fourth roller disposed on opposite second sides of the body, the shafts of the first and third rollers being parallel and the shafts of the second and fourth rollers being parallel, the axes of rotation of all four rollers being located in a plane perpendicular to the longitudinal direction of the body to be pressed, said first roller being fixed against axial and lateral movement with respect to said press frame, said second and third rollers being arranged to be immovable relative to each other in the direction of the axis of the first roller but movable together in the direction of the axis of said first roller, said third and fourth rollers being arranged to be immovable relative to each other in the direction of the axis of the second roller but movable together in the direction of the axis of the second roller.

4. The roller press of claim 3, and including a first auxiliary frame that is mounted for sliding movement on the press frame in a direction parallel to the shaft of the second and fourth rollers, said fourth roller being journaled on said auxiliary frame.

5. The roller press of claim 4, and including a second auxiliary frame mounted for sliding movement on the first auxiliary frame in a direction parallel to the shafts of the first and third rollers, said third roller being journaled on said second auxiliary frame.

6. The roller press of claim 5, wherein the second auxiliary frame is provided with a guide supporting the shaft of the second roller.

7. The roller press of claim 6, wherein the end of the shaft of the second roller is supported by a guide track attached to the press frame in a manner such that the shaft of the second roller can slide in the direction parallel to the shaft of the first roller.

8. The roller press of claim 3, and including power means mounted on the frame and operably connected to said first roller to rotate said first roller.

9. The roller press of claim 8, and including second power means mounted on said auxiliary frame and operably connected to said fourth roller to rotate said fourth roller.

10. The roller press of claim 3, wherein said press comprises a plurality of four roller units forming an elongated pressing tunnel, mutually corresponding rollers of different units being rigidly connected to each other to allow simultaneous adjustment.

11. The roller press of claim 10, and including heating means associated with said tunnel for heating the body being pressed in said tunnel.

* * * * *